US010837229B2

(12) United States Patent
Yoo

(10) Patent No.: US 10,837,229 B2
(45) Date of Patent: Nov. 17, 2020

(54) LADDER WITH A GUARDRAIL

(71) Applicant: Thomas Yoo, Garden Grove, CA (US)

(72) Inventor: Thomas Yoo, Garden Grove, CA (US)

(73) Assignee: HYUNDAI ALUMINUM VINA SHAREHOLDING COMPANY, Van Lam District (VN)

( * ) Notice: Subject to any disclaimer, the term of this patent is extended or adjusted under 35 U.S.C. 154(b) by 266 days.

(21) Appl. No.: 16/107,729

(22) Filed: Aug. 21, 2018

(65) Prior Publication Data

US 2020/0063493 A1 Feb. 27, 2020

(51) Int. Cl.
*E06C 7/18* (2006.01)

(52) U.S. Cl.
CPC ..... *E06C 7/182* (2013.01)

(58) Field of Classification Search
CPC ..... E06C 7/181; E06C 7/182; E06C 7/183; E06C 7/185; Y10T 292/0911; Y10T 292/0945; Y10T 292/0921; Y10T 292/0922; Y10T 292/0926; Y10T 292/0928; Y10T 292/1051; Y10T 292/1052; Y10T 292/63
See application file for complete search history.

(56) References Cited

U.S. PATENT DOCUMENTS 195,525 A * 9/1877 Mudgett ..... E05B 63/122 292/116
704,619 A * 7/1902 Cramer ..... E05B 63/122 292/116
732,450 A * 6/1903 Schiermeyer ..... E05B 63/122 292/116
2,467,800 A * 4/1949 Backlin ..... E06C 7/182 182/106
2,533,391 A * 12/1950 Miller ..... E06C 1/32 182/25
2,656,088 A * 10/1953 White ..... E06C 7/182 182/106
2,934,163 A * 4/1960 Ladewski ..... E06C 7/48 182/214
3,139,155 A * 6/1964 Skeels ..... E06C 7/182 182/106
4,191,397 A * 3/1980 Kassai ..... B62B 7/062 280/647
4,620,611 A * 11/1986 Good ..... E06C 7/182 182/106

(Continued)

*Primary Examiner* — Katherine W Mitchell
*Assistant Examiner* — Shiref M Mekhaeil
(74) *Attorney, Agent, or Firm* — John K. Park; Park Law Firm

(57) ABSTRACT

A ladder with a guardrail is provided. The U-shaped guardrail has a center arm portion and two side arm portions. Each slot is provided through a side arm portion and has an elongated oval shape. Each hinge center bolt is disposed through a slot and engages a side arm portion to a hinge rotatably. The guardrail lock is disposed at the side arm portion, and the guardrail lock comprises first and second locks, a center rivet, a pair of stopper pins, and a torsion spring. The first or second lock has a guiding curve portion, a circular locking portion, and a through-hole. The center rivet is queued through the through-holes and fixes the first and second locks to the side arm portion rotatably and fixed to the side arm portion. The first and second locks receives and is locked to locking pins on top portions of the side rail.

15 Claims, 14 Drawing Sheets

(56) References Cited

U.S. PATENT DOCUMENTS

| | | | | |
|---|---|---|---|---|
| 4,643,274 | A * | 2/1987 | Tataseo | E06C 7/48 182/106 |
| 7,931,123 | B2 * | 4/2011 | Moldthan | E06C 1/387 182/129 |
| 8,186,481 | B2 * | 5/2012 | Moss | F16B 7/105 182/129 |
| 9,016,434 | B2 * | 4/2015 | Moss | E06C 7/14 182/106 |
| 9,701,333 | B2 * | 7/2017 | Liu | B62B 7/08 |
| 2004/0195841 | A1 * | 10/2004 | Liu | E05B 63/14 292/24 |
| 2011/0247895 | A1 * | 10/2011 | Smith | E06C 7/182 182/106 |
| 2012/0091734 | A1 * | 4/2012 | Schendel | E05B 41/00 292/126 |
| 2018/0148977 | A1 * | 5/2018 | Leng | E06C 1/387 |
| 2018/0327002 | A1 * | 11/2018 | Nasrabad | E06C 7/182 |
| 2018/0347278 | A1 * | 12/2018 | Russell | E06C 1/16 |
| 2019/0330920 | A1 * | 10/2019 | Boyer | E06C 1/387 |
| 2020/0115959 | A1 * | 4/2020 | Cohen | E06C 7/186 |
| 2020/0165870 | A1 * | 5/2020 | Moss | E06C 1/397 |

* cited by examiner

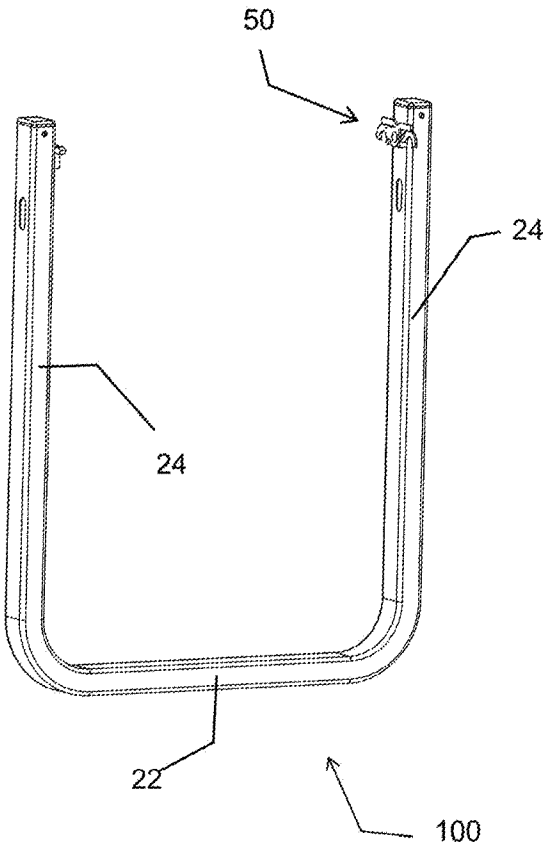
Fig. 10
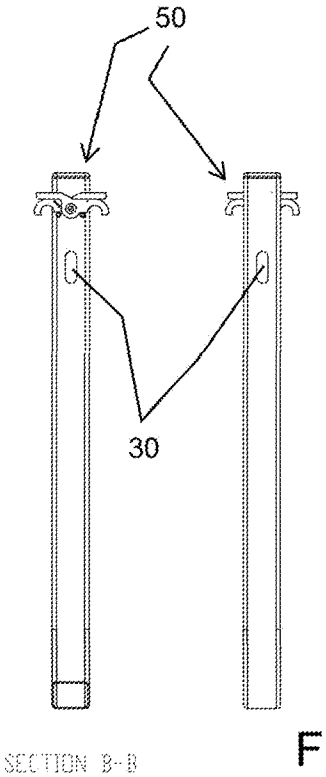
Fig. 11
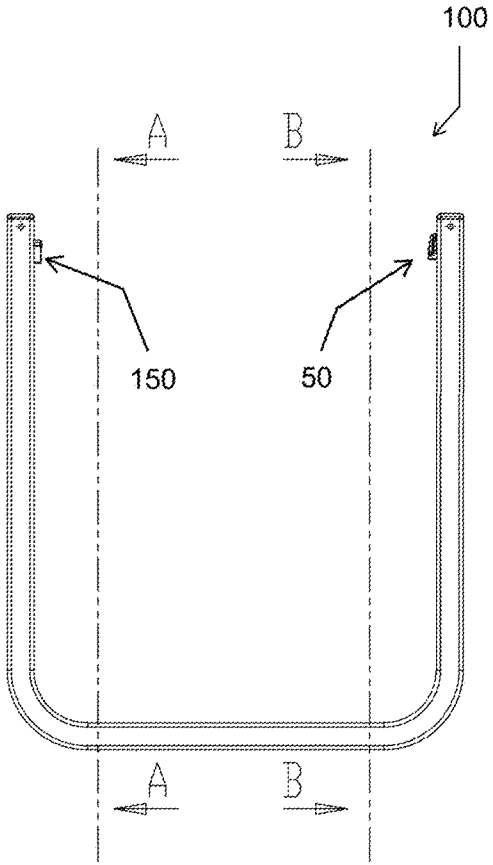
Fig. 14
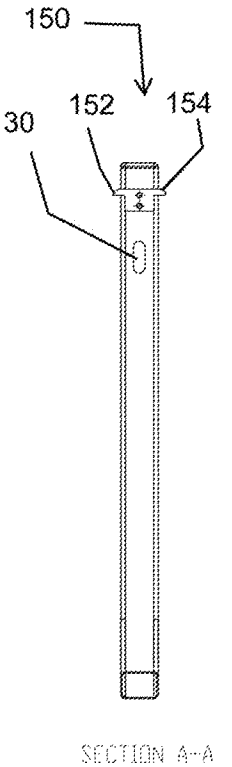
Fig. 12
Fig. 13

LADDER WITH A GUARDRAIL

BACKGROUND OF THE INVENTION

The present invention relates to a ladder with a guardrail.

The need for a guardrail locking system for ladders has been present for a long time considering the expansive demands in the everyday life. This invention is directed to solve these problems and satisfy the long-felt need.

SUMMARY OF THE INVENTION

The present invention contrives to solve the disadvantages of the prior art.

An aspect of the invention provides a ladder with a guardrail.

The ladder comprises a pair of side rails, a plurality of fixed rung portions, and a guardrail.

A guardrail locking system for a ladder having two pairs of side rails comprises a pair of hinges, a U-shaped guardrail, a pair of slots, a pair of hinge center bolts, and a guardrail lock.

The pair of hinges are configured for connecting the two pairs of side rails rotatably.

The U-shaped guardrail has a center arm portion and two side arm portions.

Each of the pair of slots is provided through a corresponding one of the two side arm portions and having an elongated oval shape in a length direction of the side arm portion.

Each of the pair of hinge center bolts is disposed through a corresponding one of the pair of slots and engaging a corresponding one of the two side arm portions to a corresponding one of the pair of hinges rotatably.

The guardrail lock is disposed at one of the two side arm portions of the pair of U-shaped guardrail, and the guardrail lock comprises first and second locks, a center rivet, a pair of stopper pins, and a torsion spring.

The first lock has a guiding curve portion, a circular locking portion, and a through-hole, and the second lock having a guiding curve portion, a circular locking portion, and a through-hole, and disposed symmetrically with the first lock about the through-holes overlapped.

The center rivet is queued through the through-holes and fixing the first and second locks to the side arm portion rotatably and fixed to the side arm portion.

The pair of stopper pins are fixed to the side arm portion and configured for stopping and limiting an angular motion of the first or second lock about the through-hole.

The torsion spring is installed about the center rivet and including two ends, each of which being hooked to the first or second lock, so that the first or second lock is recovered toward the stopper pin after being released from a push on the guiding curve portion of the first or second lock.

The first and second locks are configured to receive and be locked to locking pins provided on top portions of the corresponding side rails respectively.

The guardrail locking system may further comprise a dumb block installed at another one of the two side arm portions of the pair of U-shaped guardrail, and the dumb block comprises first and second latching portions, so that the first and second latching portions are configured to receive and be latched to corresponding locking pins provided on top portions of the corresponding side rails respectively.

The locking pins may be disposed on the top portions of the corresponding side rails, such that when deployed a width between the locking pins is wider than a width between the first and second locks.

Each of the pair of slots may be configured to have a specific length, such that when a corresponding one of the pair of hinge center bolts is disposed at a highest portion of the slot the first and second locks are disposed below the locking pins so as to be locked to one of the locking pins, and when the corresponding one of the pair of hinge center bolts is disposed at a lowest portion of the slot the first and second locks are disposed above the locking pins so that the U-shaped guardrail rotates about the hinge center bolt.

Each of the pair of hinge center bolts may have a cylindrical shape, and is queued through the corresponding hinges connecting a corresponding pair of side rails and a corresponding one of the pair of slots, engaging with a nut through threads provided at an end portion of the hinge center bolt.

The guardrail locking system may further comprise a first spacer and a first washer.

The first spacer may be provided between the hinge of the corresponding pair of side rails and the U-shaped guardrail.

The first washer may be provided between the U-shaped guardrail and the nut.

The hinge center bolt, the first spacer, and the first washer may be configured to enable the guardrail to rotate with respect to the hinge of the ladder.

The center rivet may queue through the through-hole of the first lock, the a through-hole of the torsion spring, the through-hole of the second lock, and a receptacle hole of the guardrail in order.

Each of the first and second lock may be formed in a planar form.

Each of the first and second lock may further comprise a tail portion and an engaging portion.

The tail portion may extend from the through-hole of the corresponding one of the first and second lock in opposite direction to the guiding curve portion and the circular locking portion.

The engaging hole may be provided at a location below the circular locking portion configured for fixing the torsion spring to the corresponding one of the first and second locks.

The torsion spring may comprise a coil portion, first and second leg portions, and first and second fixing ends.

The coil portion may have the through-hole inside the coil portion.

The first and second leg portions may extend from the coil portion on a plane defined by the coil portion.

The first fixing end may extend from the first leg portion and in a direction perpendicularly to the plane and configured for engaging the corresponding engaging hole of the corresponding one of the first and second locks.

The second fixing end may extend from the second leg portion and in a direction perpendicularly to the plane and configured for engaging the corresponding engaging hole of the corresponding one of the first and second locks.

The center rivet may comprise a head portion, a spacer portion, and a fixing portion.

The spacer portion may extend from the head portion by a specific length extending through the first and second locks, and the torsion spring.

The fixing portion may extend from the spacer portion and be configured for being received in and fixed to the corresponding one of the two side arm portions of the U-shaped guardrail.

The guardrail locking system may further comprise a second washer having a through-hole and provided between the corresponding side arm portion and the second lock, and the through-hole may be configured to be queued through by the spacer portion.

The center rivet may comprise a head portion, a queuing portion, and a fixing portion.

The queuing portion may extend from the head portion by a specific length extending through the first and second locks, and the torsion spring.

The fixing portion may extend from the queuing portion and be configured for being received in and fixed to the corresponding one of the two side arm portions of the U-shaped guardrail.

The guardrail locking system may further comprise a second washer having a through-hole and provided between the corresponding side arm portion and the second lock, and the through-hole may be configured to be queued through by the queuing portion.

The guardrail locking system may further comprise a second spacer and a third washer.

The second spacer may be disposed around the queuing portion of the center rivet and configured to support the first and second lock and the torsion spring against the center rivet.

The third washer may be disposed between a head of the center rivet and the first lock.

The advantages of the present invention are:

(1) the guardrail locking system for ladders according to the invention provides a reliable structural solutions for guardrail; and (2) the guardrail locking system for ladders according to the invention a stable solutions.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 10 is a perspective view of a guardrail according to an embodiment of the invention.

FIG. 11 is a side view of the guardrail of FIG. 10.

FIG. 12 is a front view of the guardrail of FIG. 10.

FIGS. 13 and 14 are inner side views of the guardrail of FIG. 10.

DETAILED DESCRIPTION EMBODIMENTS OF THE INVENTION

An object of the present invention is to provide a guardrail locking system for ladders. The guardrail locking system may be provided separately and independently from the ladder. For the guardrail locking system may be applied easily to conventional ladders. Also, the guardrail locking system may be provided inseparably from the ladder.

Figure 1:
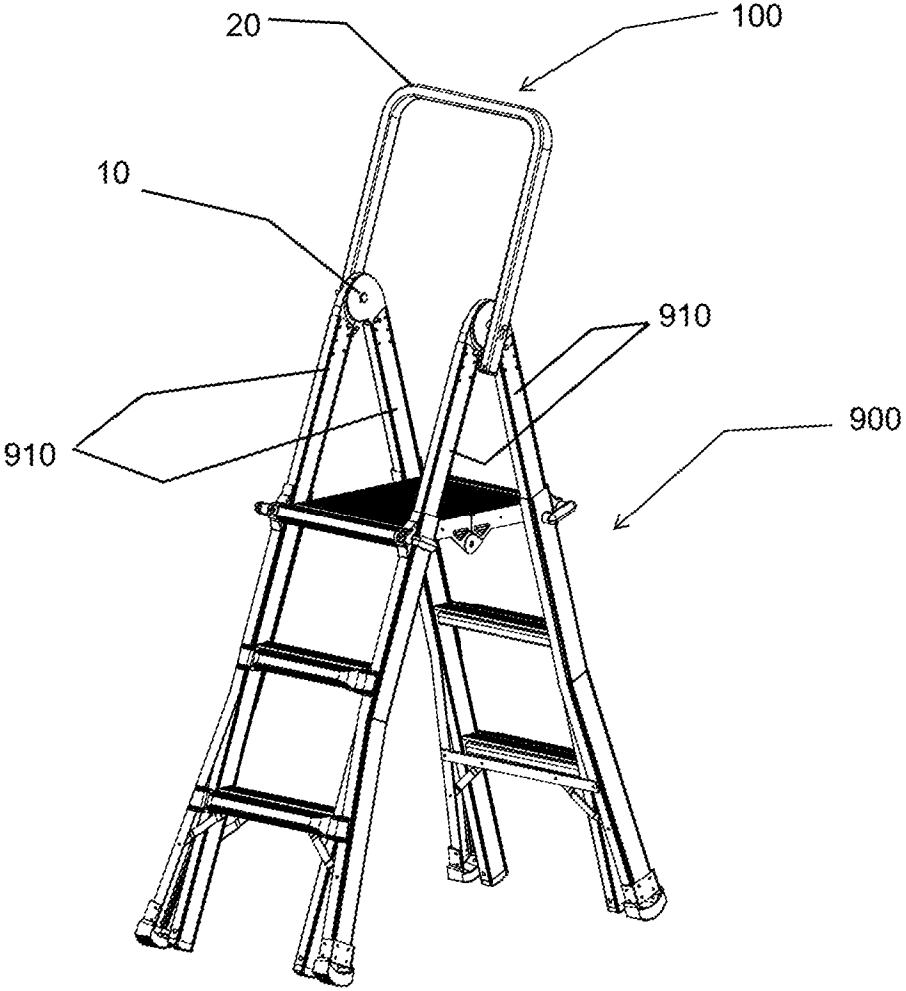
FIG. 1 is a perspective view showing a ladder with a guardrail according to an embodiment of the invention.
Figure 2:
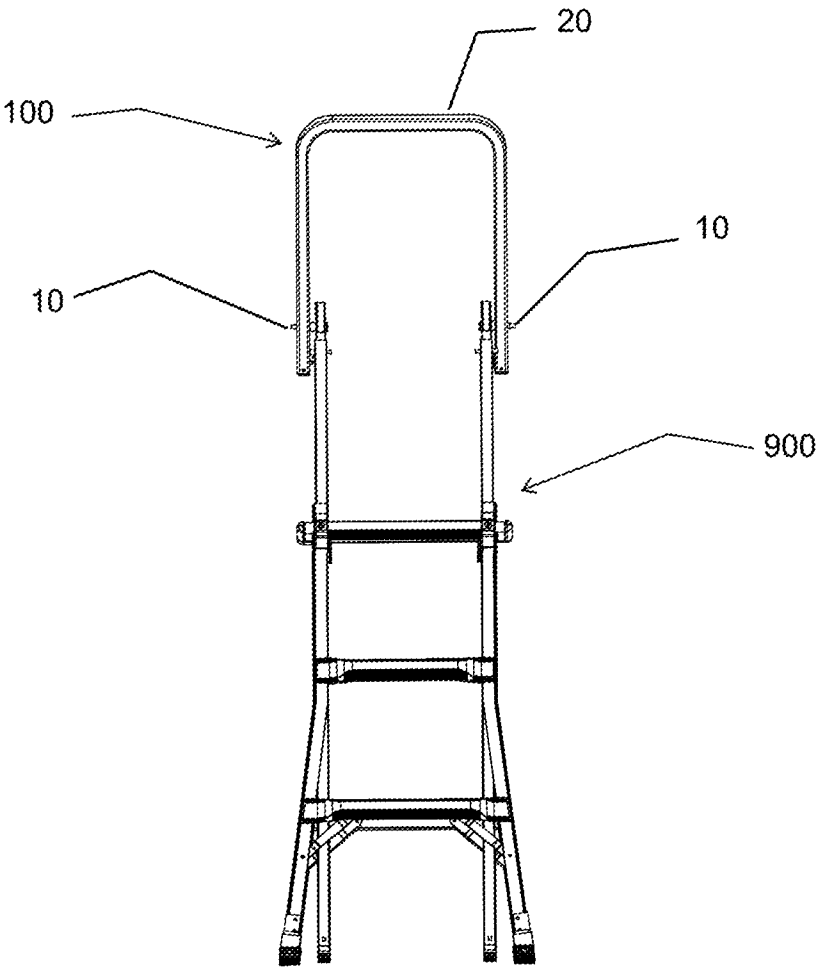
FIG. 2 is a front view showing a ladder with a guardrail according to an embodiment of the invention.
Figure 3:
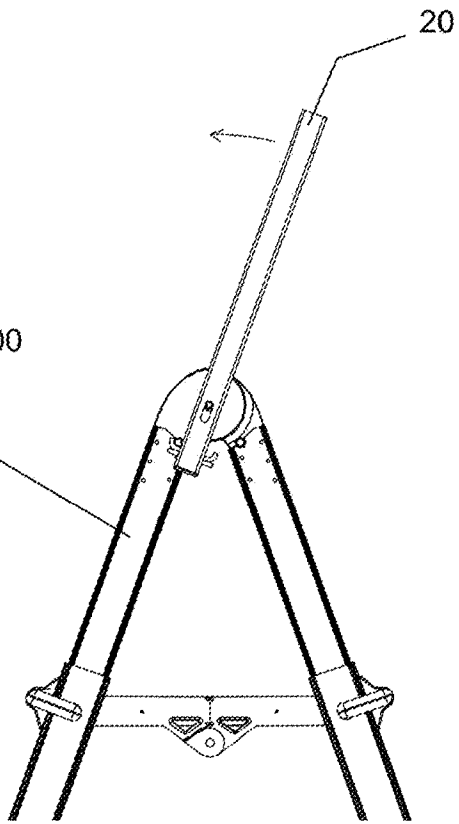
FIG. 3 is a side view of a guardrail deployed by a first angle according to an embodiment of the invention.
Figure 4:
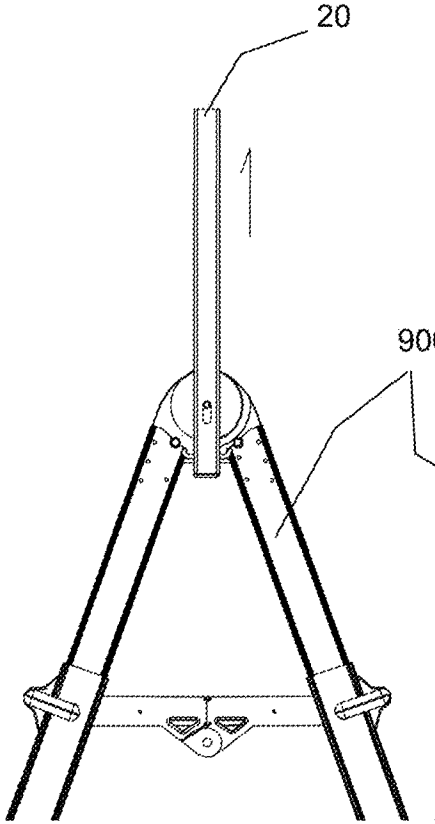
FIG. 4 is a side view of the guardrail of FIG. 3 deployed by a second angle according to an embodiment of the invention.
Figure 5:
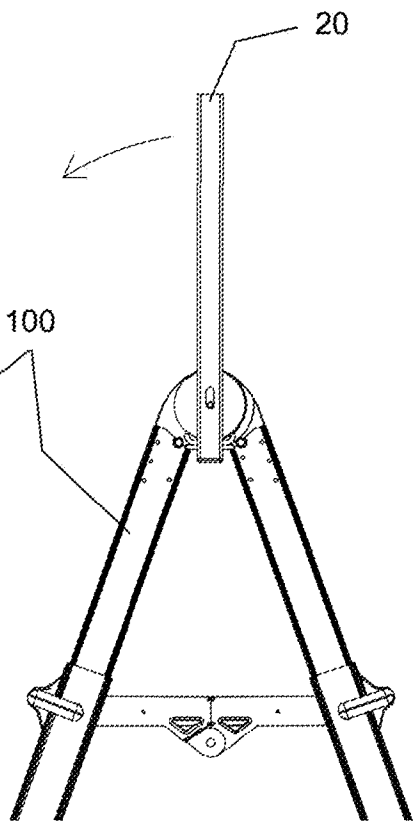
FIG. 5 is a side view of the guardrail of FIG. 3 deployed by a third angle according to an embodiment of the invention.
Figure 6:
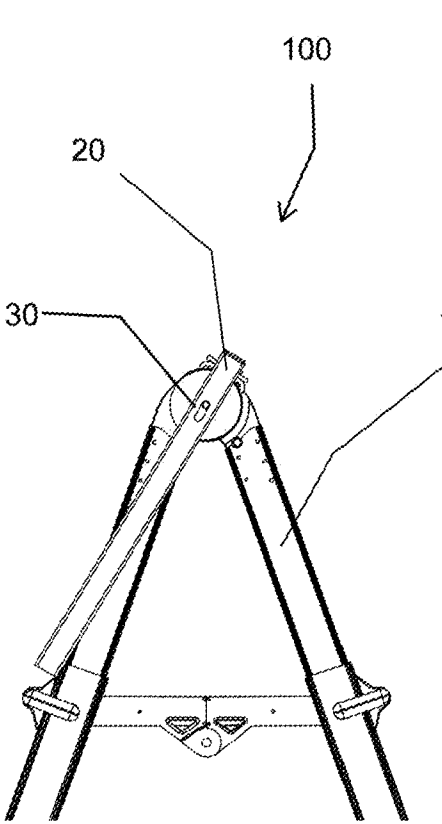
FIG. 6 is a side view of the guardrail of FIG. 3 deployed by a fourth angle according to an embodiment of the invention.

An aspect of the invention provides a ladder (900) with a guardrail locking system (100) as shown in FIGS. 1 and 2.

The ladder (900) comprises a pair of side rails, a plurality of fixed rung portions, and a guardrail or guardrail locking system (100). In the description, the guardrail locking system (100) may include the guardrail as a part thereof as shown in FIGS. 10 and 12.

The guardrail locking system (100) for a ladder (900) having two pairs of side rails (910) comprises a pair of hinges (10), a U-shaped guardrail (20), a pair of slots (30), a pair of hinge center bolts (40), and a guardrail lock (50) as shown in FIGS. 3-9.

The pair of hinges (10) are configured for connecting the two pairs of side rails (910) rotatably.

The U-shaped guardrail (20) has a center arm portion (22) and two side arm portions (24) as shown in FIG. 10.

Each of the pair of slots (30) is provided through a corresponding one of the two side arm portions (24) and has an elongated oval shape, which is long in a length direction of the side arm portion (24) as shown in FIGS. 7, 11, and 13-14. The size is configured for receiving and letting the hinge center bolt (40) to move up and down in the length direction thereof as shown in FIGS. 3-6.

Figure 9:
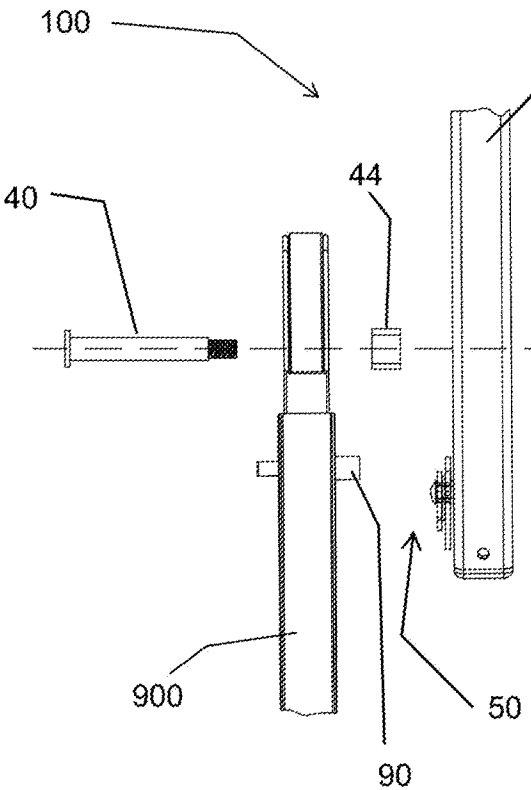
FIG. 9 is an exploded view of the guardrail and the ladder in FIG. 8 according to an embodiment of the invention.

Each of the pair of hinge center bolts (40) is disposed through a corresponding one of the pair of slots (30) and engages a corresponding one of the two side arm portions (24) to a corresponding one of the pair of hinges (10) rotatably as shown in FIG. 9. The engagement of the hinge center bolt (40), the hinge (10), the side arm portion (24), and possibly additional washer/nut may be configured so that the guardrail (20) rotate about the hinge (10) as shown in FIGS. 3-6.

Figure 16:
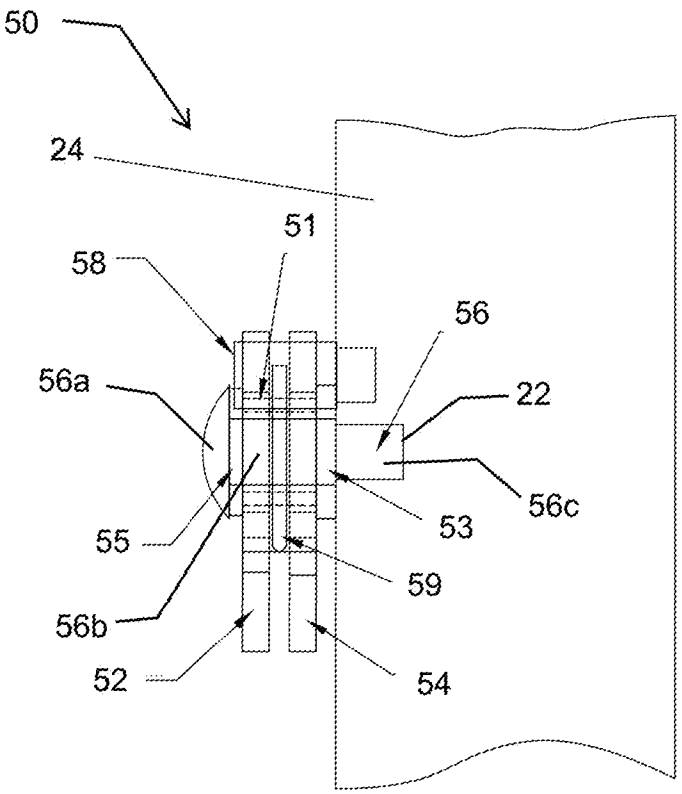
FIG. 16 is a side view of the guardrail lock of FIG. 15.
Figure 15:
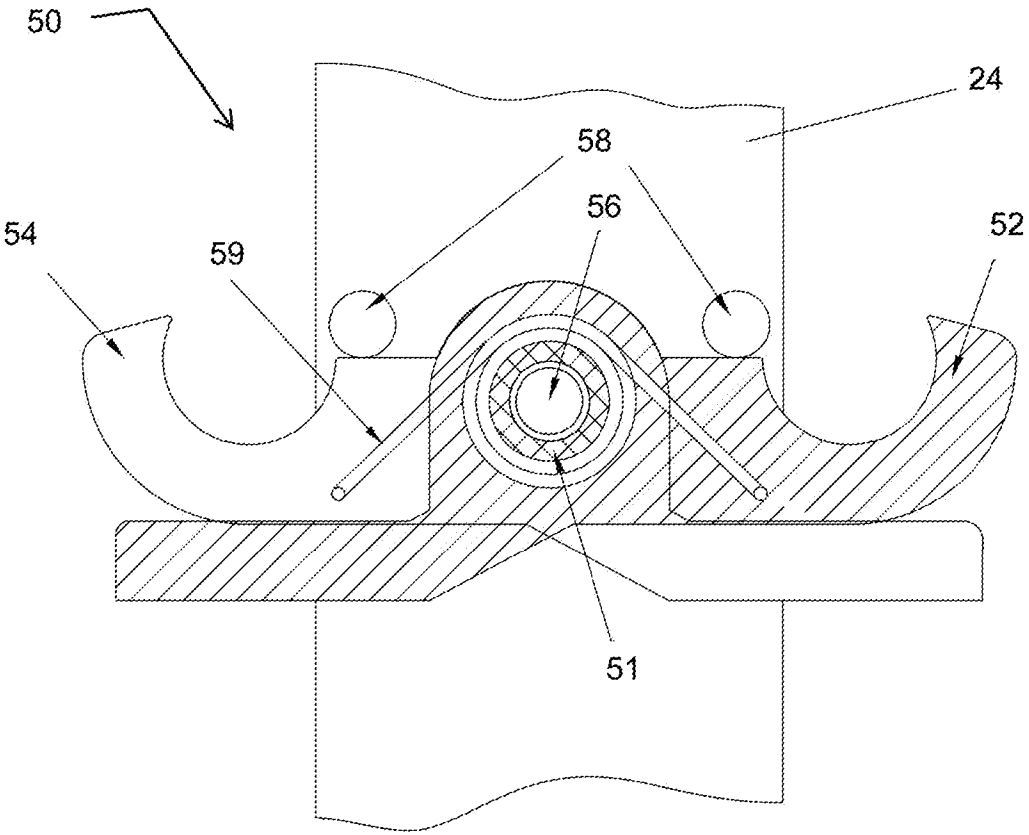
FIG. 15 is a front view of a guardrail lock according to an embodiment of the invention.
Figure 17:
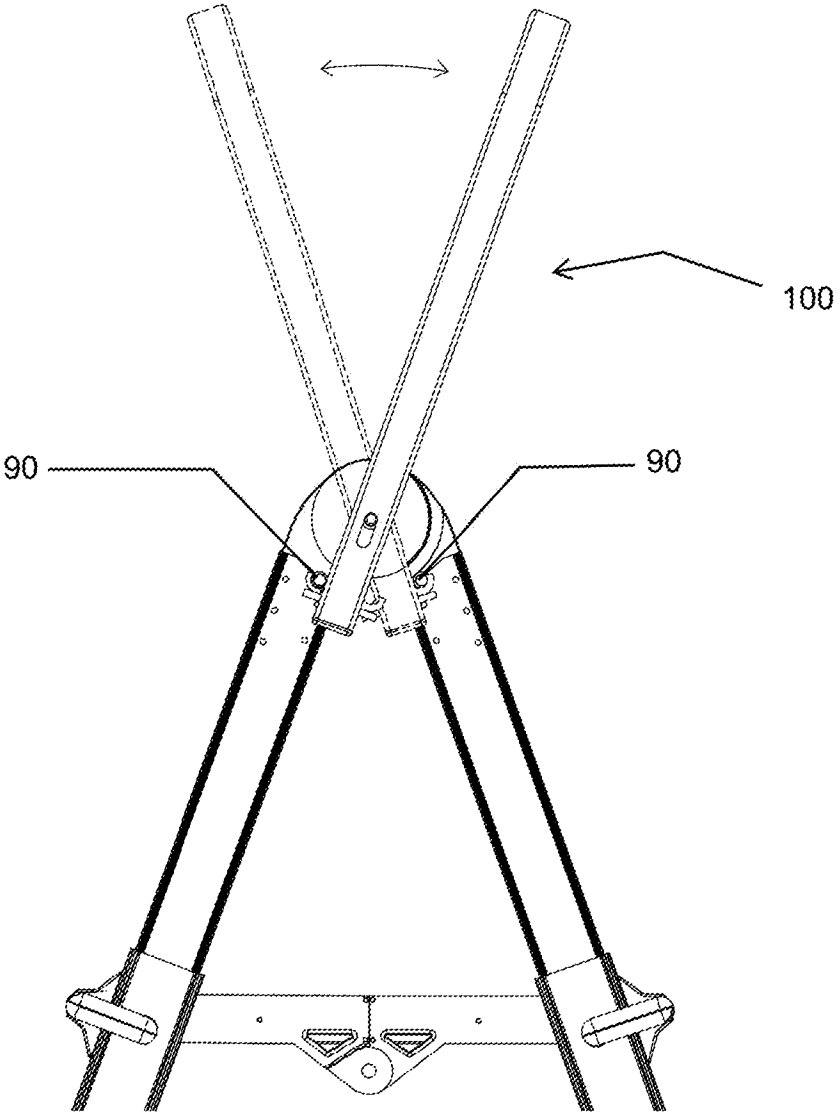
FIG. 17 is a side view showing two locking positions of a guardrail according to an embodiment of the invention.
Figure 18:
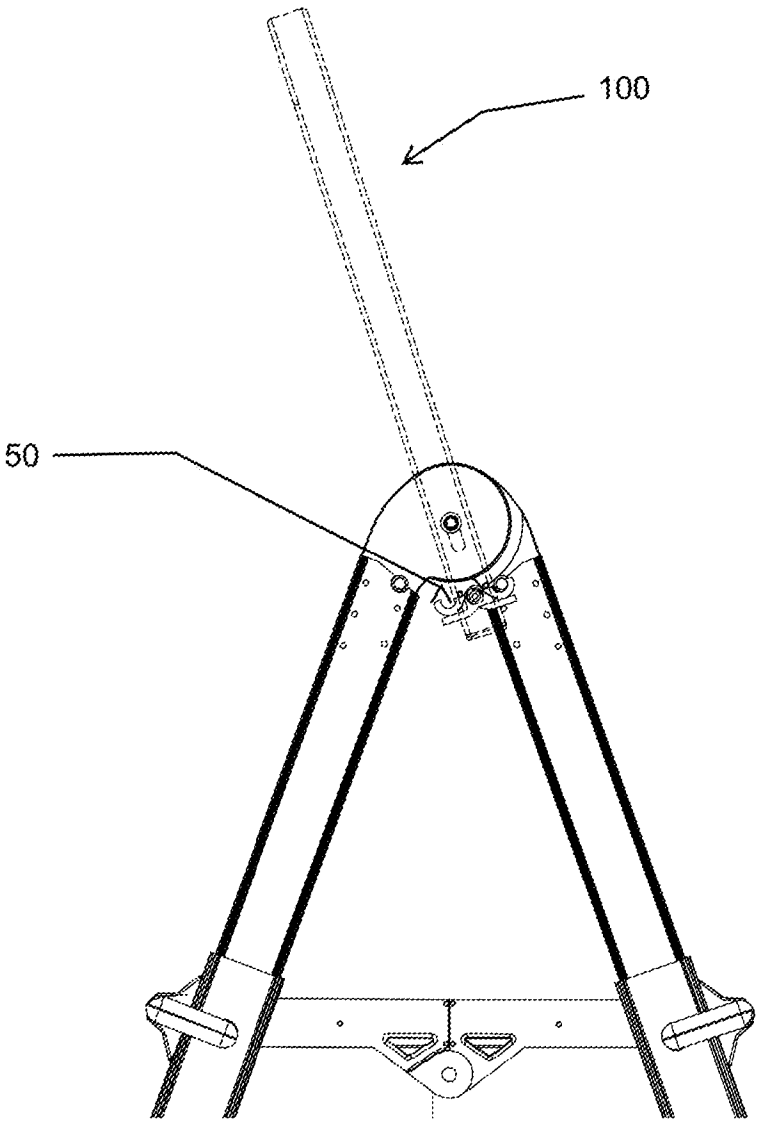
FIG. 18 is a rear view of the guardrail lock FIG. 17.
Figure 19:
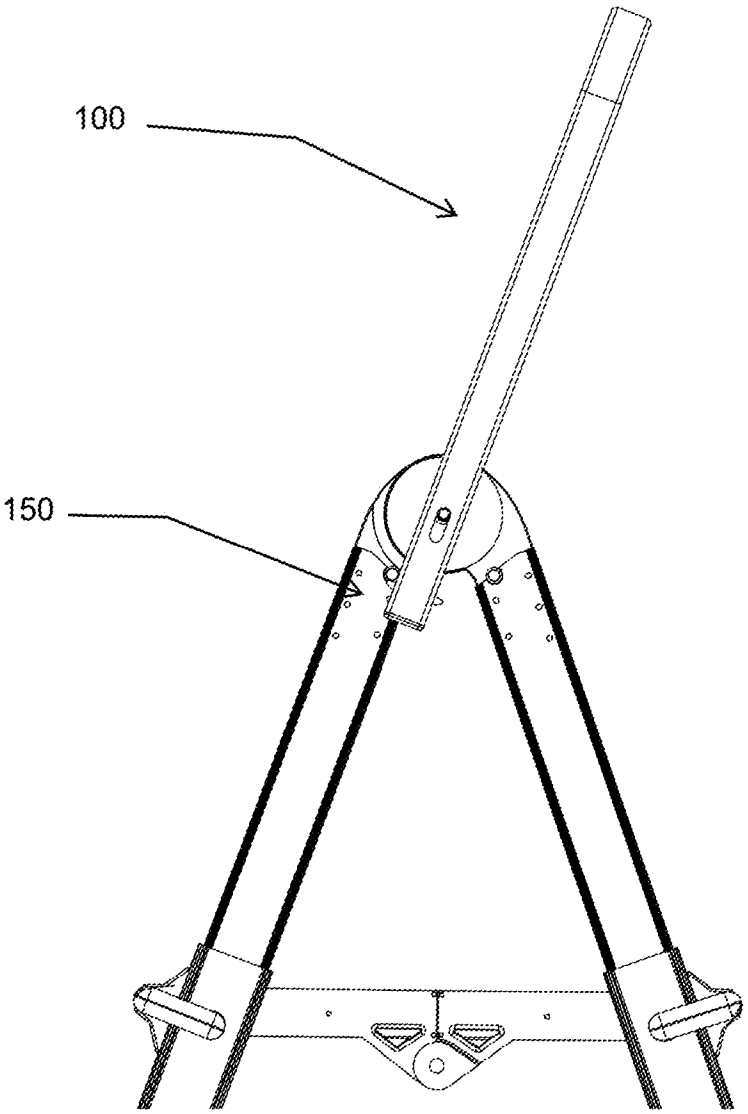
FIG. 19 is a side view of a dumb block according to an embodiment of the invention.
Figure 20:
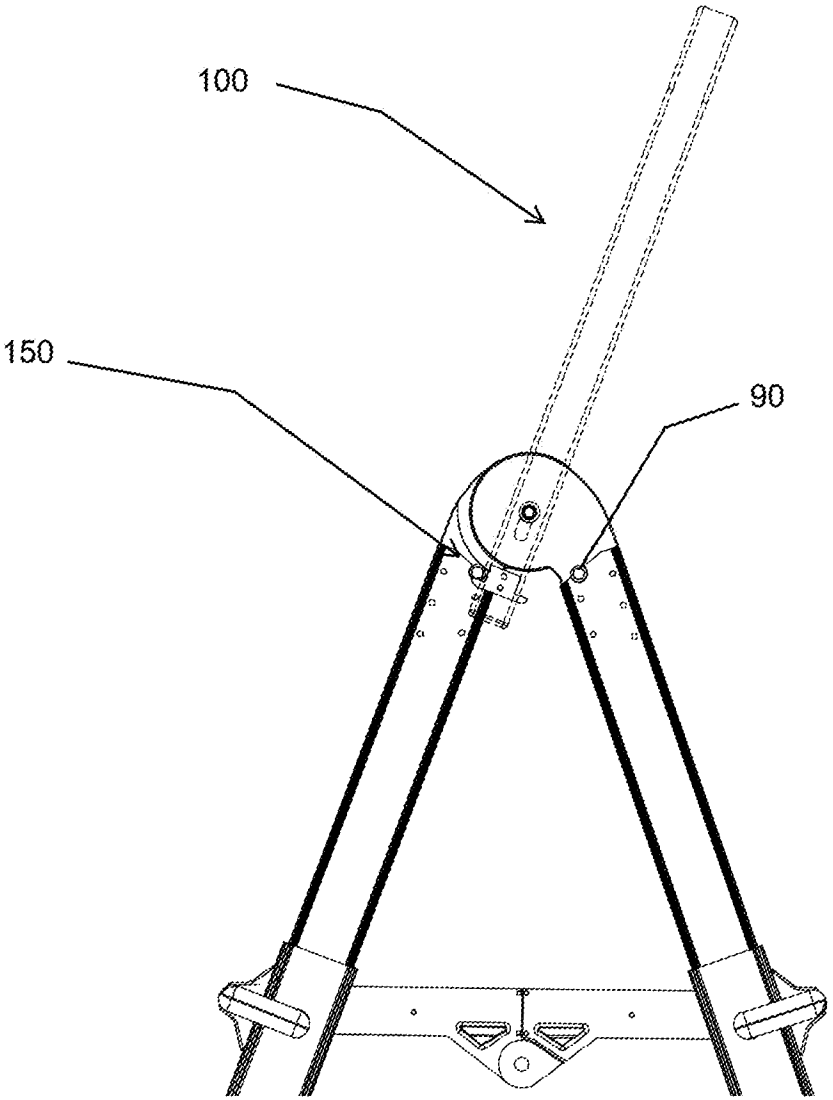
FIG. 20 is a rear view of the dumb block of FIG. 19 according to an embodiment of the invention.

The guardrail lock (50) is disposed at the side arm portion (24) of one of the two side arm portions (24) of the pair of U-shaped guardrail (20), and the guardrail lock (50) comprises first and second locks (52, 54), a center rivet (56), a pair of stopper pins (58), and a torsion spring (59) as shown in FIGS. 15-16.

The first lock (52) has a guiding curve portion (52*a*), a circular locking portion (52*b*), and a through-hole (52*c*), and the second lock (54) having a guiding curve portion (54*a*), a circular locking portion (54*b*), and a through-hole (54*c*), and disposed symmetrically with the first lock (52) about the through-holes (52*c*, 54*c*) overlapped as shown in FIGS. 15-16 and 21-25.

The center rivet (56) is queued through the through-holes (52*c*, 54*c*) and fixes the first and second locks (52, 54) to the side arm portion (24) rotatably and fixed to the side arm portion (24) of the guardrail (20) as shown in FIGS. 15-16 and 21-25.

The pair of stopper pins (58) are fixed to the side arm portion (24) and configured for stopping and limiting an angular motion of the first or second lock (52, 54) about the through-hole (52*c*, 54*c*) as shown in FIGS. 15-16 and 24-25.

The torsion spring (59) is installed about the center rivet (56, 57) and includes two ends (59*d*), each of which being hooked to the first or second lock (52, 54), so that the first or second lock (52, 54) is recovered toward the stopper pin (58) after being released from a push on the guiding curve portion (52*a*, 54*a*) of the first or second lock (52, 54) as shown in FIGS. 15-16 and 23-25.

The first and second locks (52, 54) are configured to receive and be locked to locking pins (90) provided on top portions of the corresponding side rails (910) respectively as shown in FIGS. 7-9 and 17.

The guardrail locking system (100) may further comprise a dumb block (150) installed at another one of the two side arm portions (24) of the pair of U-shaped guardrail (20), and the dumb block (150) comprises first and second latching portions (152, 154), so that the first and second latching portions (152, 154) are configured to receive and be latched to corresponding locking pins (90) provided on top portions of the corresponding side rails (910) respectively as shown in FIGS. 10-14 and 19-20.

The locking pins (90) may be disposed on the top portions of the corresponding side rails (910), such that when deployed a width between the locking pins (90) is wider than a width between the first and second locks (52, 54, 152, 154).

Each of the pair of slots (30) may be configured to have a specific length, such that when a corresponding one of the pair of hinge center bolts (40) is disposed at a highest portion of the slot (30) the first and second locks (52, 54) are disposed below the locking pins (90) so as to be locked to one of the locking pins (90), and when the corresponding one of the pair of hinge center bolts (40) is disposed at a lowest portion of the slot (30) the first and second locks (52, 54) are disposed above the locking pins (90) so that the U-shaped guardrail (20) rotates about the hinge center bolt (40) as shown in FIGS. 3-6 and 17-20. The same holds true for the first and second locks (152, 154).

Figure 7:
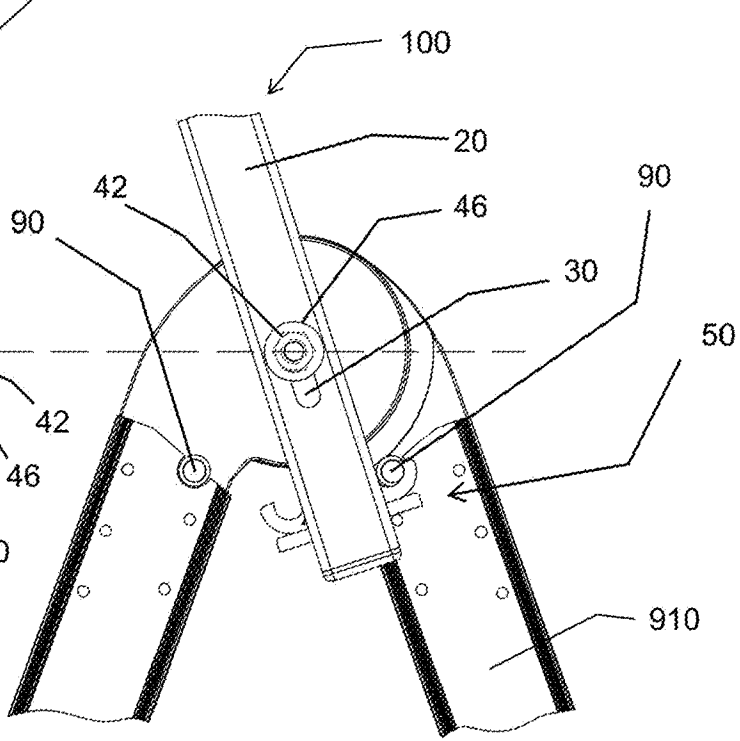
FIG. 7 is a close-up side view of a guardrail installed on a hinge of a ladder according to an embodiment of the invention.
Figure 8:
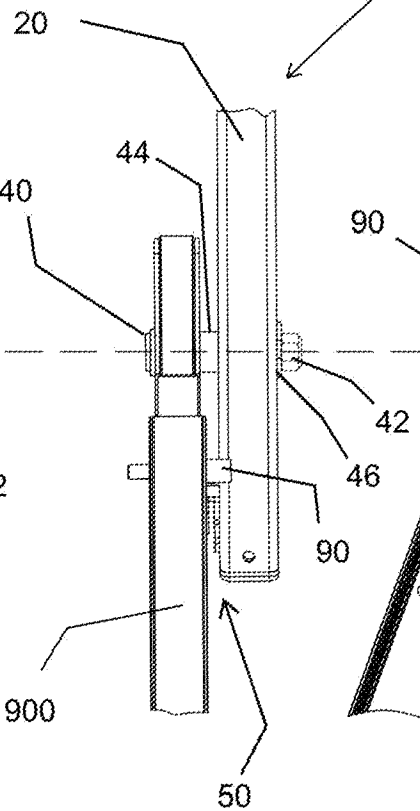
FIG. 8 is a side view of the guardrail installed in FIG. 7 according to an embodiment of the invention.

Each of the pair of hinge center bolts (40) may have a cylindrical shape, and is queued through the corresponding hinges (10) connecting a corresponding pair of side rails (910) and a corresponding one of the pair of slots (30), engaging with a nut (42) through threads provided at an end portion of the hinge center bolt (40) as shown in FIGS. 7-9. The guardrail locking system may further comprise a first spacer (44) and a first washer (46).

The first spacer (44) may be provided between the hinge (10) of the corresponding pair of side rails (910) and the U-shaped guardrail (20) as shown in FIGS. 7-9.

The first washer (46) may be provided between the U-shaped guardrail (20) and the nut (42) as shown in FIGS. 7-9.

The hinge center bolt (40), the first spacer (44), and the first washer (46) may be configured to enable the guardrail (20) to rotate with respect to the hinge (10) of the ladder (900).

Figure 23:
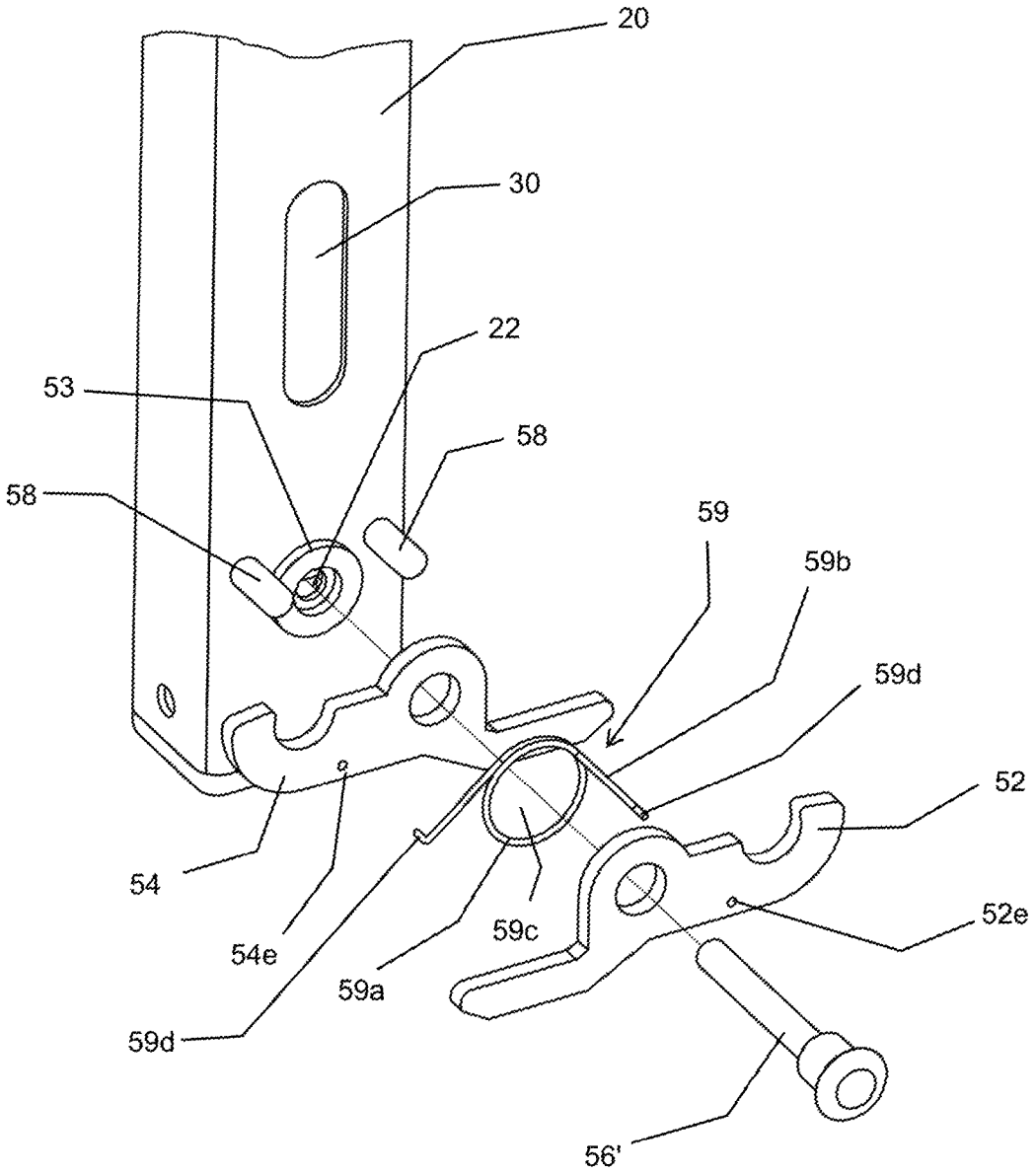
FIG. 23 is a perspective exploded view of a guardrail lock according to an embodiment of the invention.
Figure 25:
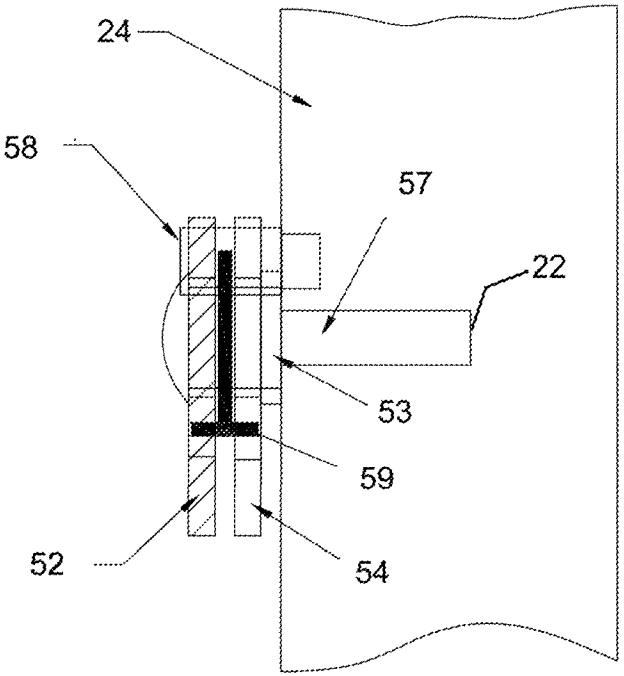
FIG. 25 is a side view of the guardrail lock of FIG. 24.
Figure 24:
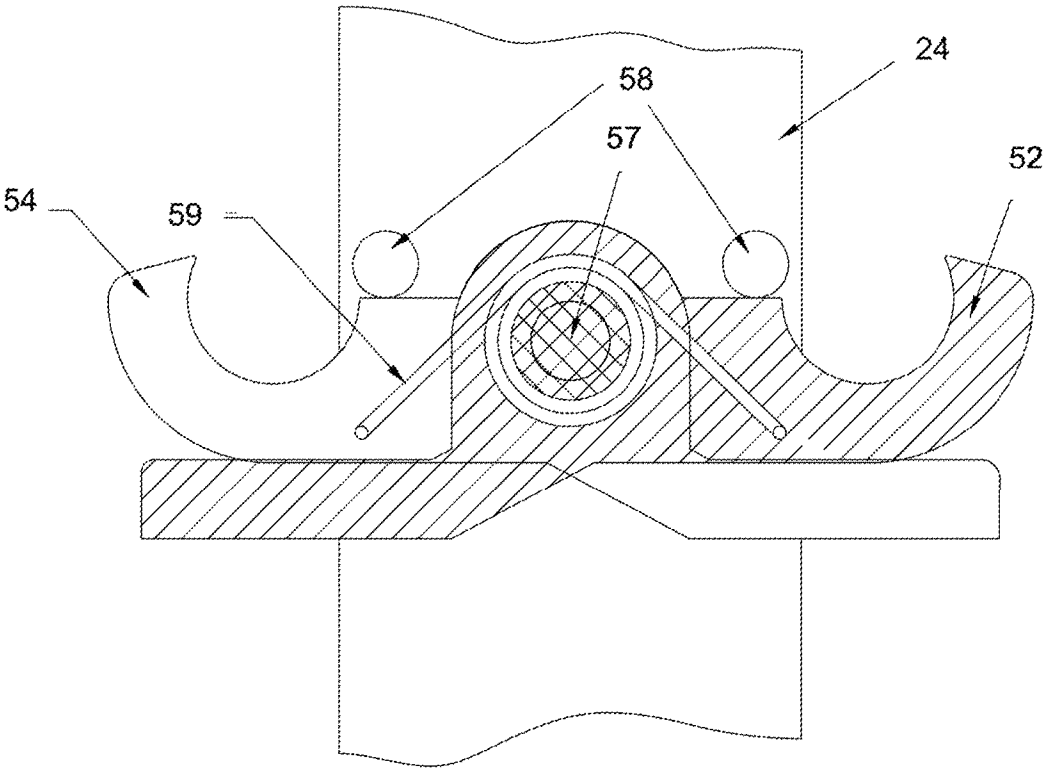
FIG. 24 is a front view of a guardrail lock according to another embodiment of the invention.
Figure 26:
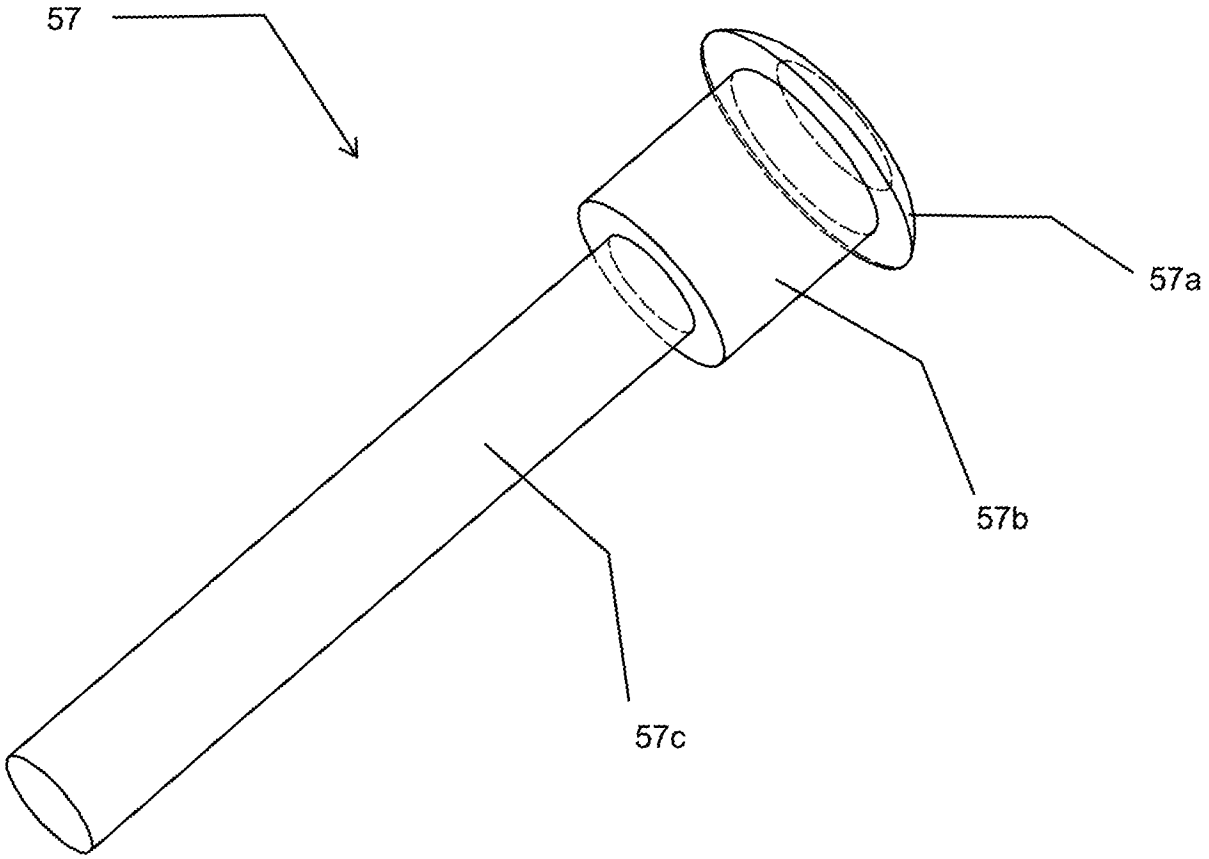
FIG. 26 is a perspective view of a center rivet of the guardrail lock of FIG. 24.

The center rivet (56, 57) may queue through the through-hole (52*c*) of the first lock (52), the a through-hole (59*c*) of the torsion spring (59), the through-hole (54*c*) of the second lock (54), and a receptacle hole (22) of the guardrail (20) in order as shown in FIGS. 16, 23, and 25.

Figure 21:
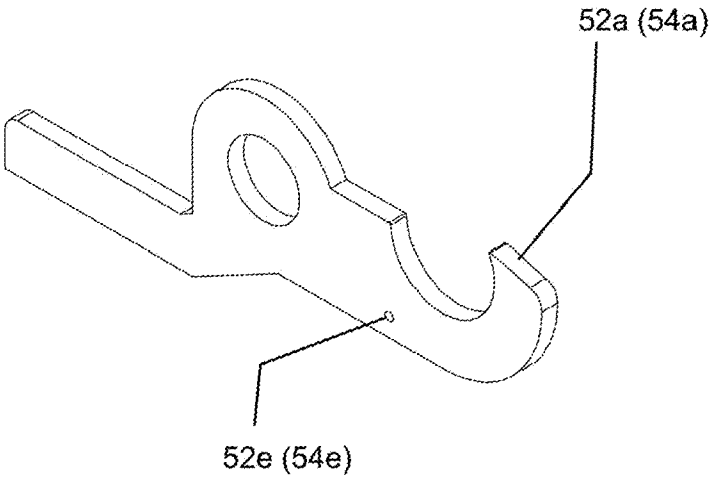
FIG. 21 is a perspective view of first or second lock according to an embodiment of the invention.
Figure 22:
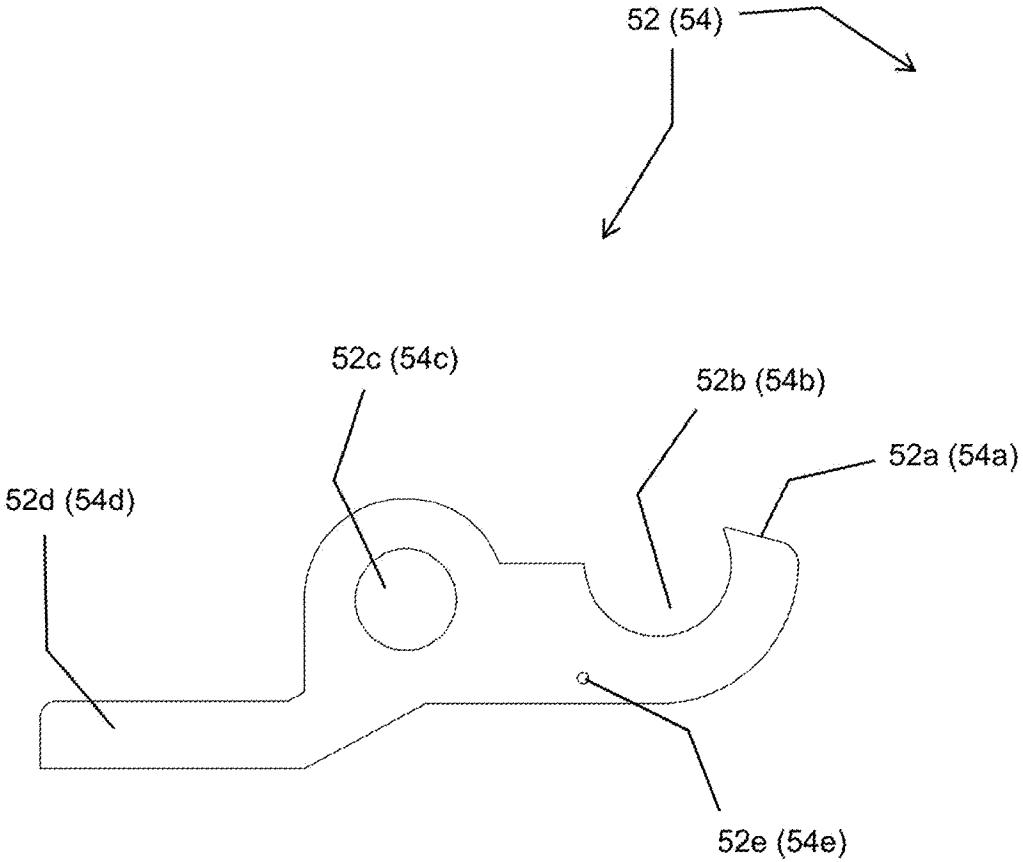
FIG. 22 is a front plan view of the first or second lock of FIG. 21 according to an embodiment of the invention.

Each of the first and second lock (52, 54) may be formed in a planar form as shown in FIGS. 21-23.

Each of the first and second lock (52, 54) may further comprise a tail portion (52*d*, 54*d*) and an engaging portion (52*e*, 54*e*) as shown in FIGS. 21-23.

The tail portion (52*d*, 54*d*) may extend from the through-hole (52*c*, 54*c*) of the corresponding one of the first and second lock (52, 54) in opposite direction to the guiding curve portion (52*a*, 54*a*) and the circular locking portion (52*b*, 54*b*). The tail portion (52*d*, 54*d*) may make the movements of the first or second lock (52, 54) stabilized further.

The engaging hole (52*e*, 54*e*) may be provided at a location below the circular locking portion (52*b*, 54*b*) configured for fixing the torsion spring (59) to the corresponding one of the first and second locks (52, 54).

The torsion spring (59) may comprise a coil portion (59*a*), first and second leg portions (59*b*), and first and second fixing ends (59*d*) as shown in FIGS. 15-16 and 23-25.

The coil portion (59) may have the through-hole (59*c*) inside the coil portion (59*a*).

The first and second leg portions (59*d*) may extend from the coil portion (59*a*) on a plane defined by the coil portion (59*a*).

The first fixing end (59*d*) may extend from the first leg portion (59*b*) and in a direction perpendicularly to the plane and configured for engaging the corresponding engaging hole (52*e*) of the corresponding one of the first and second locks (52, 54).

The second fixing end (59*d*) may extend from the second leg portion (59*b*) and in a direction perpendicularly to the plane and configured for engaging the corresponding engaging hole (54*e*) of the corresponding one of the first and second locks (52, 54).

In a first embodiment of the invention, the center rivet (57) may comprise a head portion (57*a*), a spacer portion (57*b*), and a fixing portion (57*c*) as shown in FIGS. 23-26.

The spacer portion (57*b*) may extend from the head portion (57*a*) by a specific length extending through the through-holes of the first and second locks (52, 54), and the torsion spring (59).

The fixing portion (57*c*) may extend from the spacer portion (57*b*) and be configured for being received in and fixed to the corresponding one of the receptacle holes (22) of the two side arm portions (24) of the U-shaped guardrail (20).

The guardrail locking system (100) may further comprise a second washer (53) having a through-hole in the center and provided between the corresponding side arm portion (24) and the second lock (54), and the through-hole may be configured to be queued through by the spacer portion (57*b*) as shown in FIGS. 23 and 25.

In a second embodiment of the invention, the center rivet (56) may comprise a head portion (56*a*), a queuing portion (56*b*), and a fixing portion (56*c*) as shown in FIGS. 15-16. It looks like the center rivet (57) in the first embodiment in the above without the spacer portion (57*b*), but the queuing portion (56*b*) has a diameter same as the fixing portion (56*c*).

The queuing portion (56*b*) may extend from the head portion (56*a*) by a specific length extending through the first and second locks (52, 54) and the torsion spring (59).

The fixing portion (56*c*) may extend from the queuing portion (56*b*) and be configured for being received in and fixed to the corresponding one of the two side arm portions (24) of the U-shaped guardrail (20).

The guardrail locking system (100) may further comprise a second washer (53) having a through-hole and provided between the corresponding side arm portion (24) and the second lock (54), and the through-hole may be configured to be queued through by the queuing portion (56*b*).

The guardrail locking system (100) may further comprise a second spacer (51) and a third washer (55).

The second spacer (51) may be disposed around the queuing portion (56*b*) of the center rivet (56) and configured to support the first and second locks (52, 54) and the torsion spring (59) against the center rivet (56) as shown in FIGS. 15-16.

The third washer (55) may be disposed between a head portion (56*a*) of the center rivet (56) and the first lock (52). In the illustrated embodiment.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A guardrail locking system for a ladder having two pairs of side rails, the guardrail locking system comprising:

a pair of hinges configured for connecting the two pairs of side rails rotatably;

a U-shaped guardrail having a center arm portion and two side arm portions;

a pair of slots, each of which being provided through a corresponding one of the two side arm portions and having an elongated oval shape in a length direction of the side arm portion;

a pair of hinge center bolts, each of which being disposed through a corresponding one of the pair of slots and engaging a corresponding one of the two side arm portions to a corresponding one of the pair of hinges rotatably; and a guardrail lock disposed at one of the two side arm portions of the pair of U-shaped guardrail, wherein the guardrail lock comprises:

a first lock having a guiding curve portion, a circular locking portion, and a through-hole;

a second lock having a guiding curve portion, a circular locking portion, and a through-hole, and disposed symmetrically with the first lock about the through-holes overlapped;

a center rivet queued through the through-holes of both the first and second locks, said center rivet rotatably fixing the first and second locks to the one of the two side arm portions;

a pair of stopper pins fixed to the one of the two side arm portion and configured for stopping and limiting an angular motion of the first or second lock about the through-hole; and a torsion spring installed about the center rivet and including two ends, each of which is hooked to a respective one of the first and second locks, so that respective one of the first and second locks is recovered toward a respective stopper pin after being released from a push on a respective one of the guiding curve portions of the respective one of the first and second locks, wherein the first and second locks are configured to receive and be locked to locking pins provided on top portions of the corresponding side rails respectively.

2. The guardrail locking system of claim 1, further comprising a dumb block installed at another one of the two side arm portions of the pair of U-shaped guardrail, wherein the dumb block comprises first and second latching portions, so that the first and second latching portions are configured to receive and be latched to corresponding locking pins provided on top portions of the corresponding side rails respectively.

3. The guardrail locking system of claim 1, wherein the locking pins are disposed on the top portions of the corresponding side rails, such that when deployed a width between the locking pins is wider than a width between the first and second locks.

4. The guardrail locking system of claim 3, wherein each of the pair of slots is configured to have a specific length, such that when a corresponding one of the pair of hinge center bolts is disposed at a highest portion of the slot the first and second locks are disposed below the locking pins so as to be locked to one of the locking pins, and when the corresponding one of the pair of hinge center bolts is disposed at a lowest portion of the slot the first and second locks are disposed above the locking pins so that the U-shaped guardrail rotates about the hinge center bolt.

5. The guardrail locking system of claim 1, wherein each of the pair of hinge center bolts has a cylindrical shape, and is queued through the corresponding hinges connecting a corresponding pair of side rails and a corresponding one of the pair of slots, engaging with a nut through threads provided at an end portion of the hinge center bolt.

6. The guardrail locking system of claim 5, further comprising:

a first spacer provided between the hinge of the corresponding pair of side rails and the U-shaped guardrail; and a first washer provided between the U-shaped guardrail and the nut, wherein the hinge center bolt, the first spacer, and the first washer are configured to enable the guardrail to rotate with respect to the hinge of the ladder.

7. The guardrail locking system of claim 1, wherein the center rivet queues through the through-hole of the first lock, the a through-hole of the torsion spring, the through-hole of the second lock, and a receptacle hole of the guardrail in order.

8. The guardrail locking system of claim 7, wherein each of the first and second lock is formed in a planar form.

9. The guardrail locking system of claim 8, wherein each of the first and second lock further comprises:

a tail portion extending from the through-hole of the corresponding one of the first and second lock in opposite direction to the guiding curve portion and the circular locking portion; and an engaging hole provided at a location below the circular locking portion configured for fixing the torsion spring to the corresponding one of the first and second locks.

10. The guardrail locking system of claim 9, wherein the torsion spring comprises:

a coil portion having the through-hole inside the coil portion;

a first leg portion extending from the coil portion on a plane defined by the coil portion;

a second leg portion extending from the coil portion on the plane defined by the coil portion;

a first fixing end extending from the first leg portion and in a direction perpendicularly to the plane and configured for engaging the corresponding engaging hole of the corresponding one of the first and second locks; and a second fixing end extending from the second leg portion and in a direction perpendicularly to the plane and configured for engaging the corresponding engaging hole of the corresponding one of the first and second locks.

11. The guardrail locking system of claim 7, wherein the center rivet comprises:

a head portion;

a spacer portion extending from the head portion by a specific length extending through the first and second locks, and the torsion spring; and a fixing portion extending from the spacer portion and configured for being received in and fixed to the corresponding one of the two side arm portions of the U-shaped guardrail.

12. The guardrail locking system of claim 11, further comprising a second washer having a through-hole and provided between the corresponding side arm portion and the second lock, wherein the through-hole is configured to be queued through by the spacer portion.

13. The guardrail locking system of claim 7, wherein the center rivet comprises:

a head portion;

a queuing portion extending from the head portion by a specific length extending through the first and second locks, and the torsion spring; and a fixing portion extending from the queuing portion and configured for being received in and fixed to the corresponding one of the two side arm portions of the U-shaped guardrail.

14. The guardrail locking system of claim 13, further comprising a second washer having a through-hole and provided between the corresponding side arm portion and the second lock, wherein the through-hole is configured to be queued through by the queuing portion.

15. The guardrail locking system of claim 13, further comprising:

a second spacer disposed around the queuing portion of the center rivet and configured to support the first and second lock and the torsion spring against the center rivet; and a third washer disposed between a head of the center rivet and the first lock.

* * * * *